US005412889A

United States Patent [19]

Hou

[11] Patent Number: 5,412,889

[45] Date of Patent: May 9, 1995

[54] ORNAMENTAL DISPLAY ASSEMBLY HAVING RECIPROCATING AND ROTATING DECORATIVE ELEMENTS

[75] Inventor: Jack Hou, Taipei, Taiwan, Prov. of China

[73] Assignee: Giftec, Ltd., Alexandria, Va.

[21] Appl. No.: 43,786

[22] Filed: Apr. 6, 1993

[51] Int. Cl.[6] ..... G09F 19/08

[52] U.S. Cl. ..... 40/411; 446/238; 84/95.2; 74/22 R

[58] Field of Search ..... 40/411, 414; 446/238, 446/280, 288; 472/6, 7, 8, 9, 10, 11; 84/94.2, 95.1, 85.2; 74/22 R, 55, 67; 175/170, 202; 166/285, 286

[56] References Cited

U.S. PATENT DOCUMENTS 4,890,828 1/1990 Hou .
4,939,944 7/1990 Hou .
5,050,409 6/1991 Hou .
5,078,386 1/1992 Hou et al. ..... 472/7
5,081,899 1/1992 Hou et al. .
5,157,217 10/1992 Feng .
5,276,271 1/1994 Huang et al. ..... 84/94.2

*Primary Examiner*—Brian K. Green
*Attorney, Agent, or Firm*—Bacon & Thomas

[57] ABSTRACT

An ornamental display assembly incorporates a pair of coaxial support members and has a decorative element mounted on each support member. A cam drive system provides one support member with reciprocating motion while providing the other support member with rotating motion. The drive system may include an eccentrically mounted circular cam in frictional contact with a drive disc associated with the ends of the support members, or may include a centrally mounted cam member having an offset cam stub which engages a slide member to provide the reciprocating motion and which may be either in frictional contact with a drive disc to supply the rotating motion, or may be drivingly connected to the drive disc via interengaging gear teeth. In each case, the sole power supply comes from the output shaft of a power source, such as a music box mechanism.

19 Claims, 5 Drawing Sheets

ORNAMENTAL DISPLAY ASSEMBLY HAVING RECIPROCATING AND ROTATING DECORATIVE ELEMENTS

BACKGROUND OF THE INVENTION

The present invention relates to ornamental display assemblies, more particularly such assemblies having reciprocating and rotating decorative elements actuated by a common power source.

It is well known in the art to provide ornamental display assemblies, such as carrousels, or the like, with movable decorative elements which may be driven by a self-contained power source, such as a music box mechanism. The music box mechanism is typically powered by a wind-up main spring which is utilized to rotate a music drum which, in turn, may have a rotating output shaft thereon. As the main spring unwinds, it drives the music drum to provide musical sounds, while at the same time such musical drum rotation rotates an output shaft.

Devices of this type are often provided with a plurality of decorative ornaments and may be provided with a mechanism to cause the decorative ornaments to move as the music drum rotates. The decorative elements are usually mounted on a support member which is associated with the drive mechanism to provide the movement to the decorative element.

In order to provide reciprocating movement and rotational movement to different decorative objects of the ornamental device, it is known to use the output shaft of the music drum to provide the power source for the reciprocating movement of a decorative element and to use the unwinding of the music box main spring to provide the rotational movement to a separate decorative element. While this concept provides a variety of movements to the decorative elements, the use of separate drive systems requires that the decorative elements be laterally spaced apart on the ornamental display assembly. Such a placement inherently requires a complex drive system to provide the desired motion to the decorative elements.

SUMMARY OF THE INVENTION

The present invention provides an ornamental display assembly having reciprocating and rotating decorative elements in which a common drive system is utilized to supply both the reciprocating and rotating movement to the separate decorative elements. The drive system may be utilized to supply reciprocating or rotating movement to either one of the decorative elements, thereby allowing the decorative elements to be closely spaced on the ornamental display assembly, but still undergo differing types of movement.

The ornamental display assembly according to this invention incorporates a pair of coaxial support members and has a decorative element mounted on each support member. A cam drive system provides one support member with reciprocating motion while providing the other support member with rotating motion. The drive system may include an eccentrically mounted circular cam in frictional contact with a drive disc associated with the ends of the support members, or may include a centrally mounted cam member having an offset cam stub which engages a slide member to provide the reciprocating motion and which may be either in frictional contact with a drive disc to supply the rotating motion, or may be drivingly connected to the drive disc via interengaging gear teeth. In each case, the sole power supply comes from the output shaft of a power source, such as music box mechanism.

The drive mechanism according to the present invention enables the decorative elements to be closely mounted, while at the same time provides each with differing motions to provide more entertainment for the user.

DETAILED DESCRIPTION OF THE PREFERRED EMBODIMENTS

Although the present invention will be explained in conjunction with a carousel type ornamental display assembly, it is to be understood that the principals elucidated herein can be utilized with virtually any type of decorative display assembly.

Figure 1:
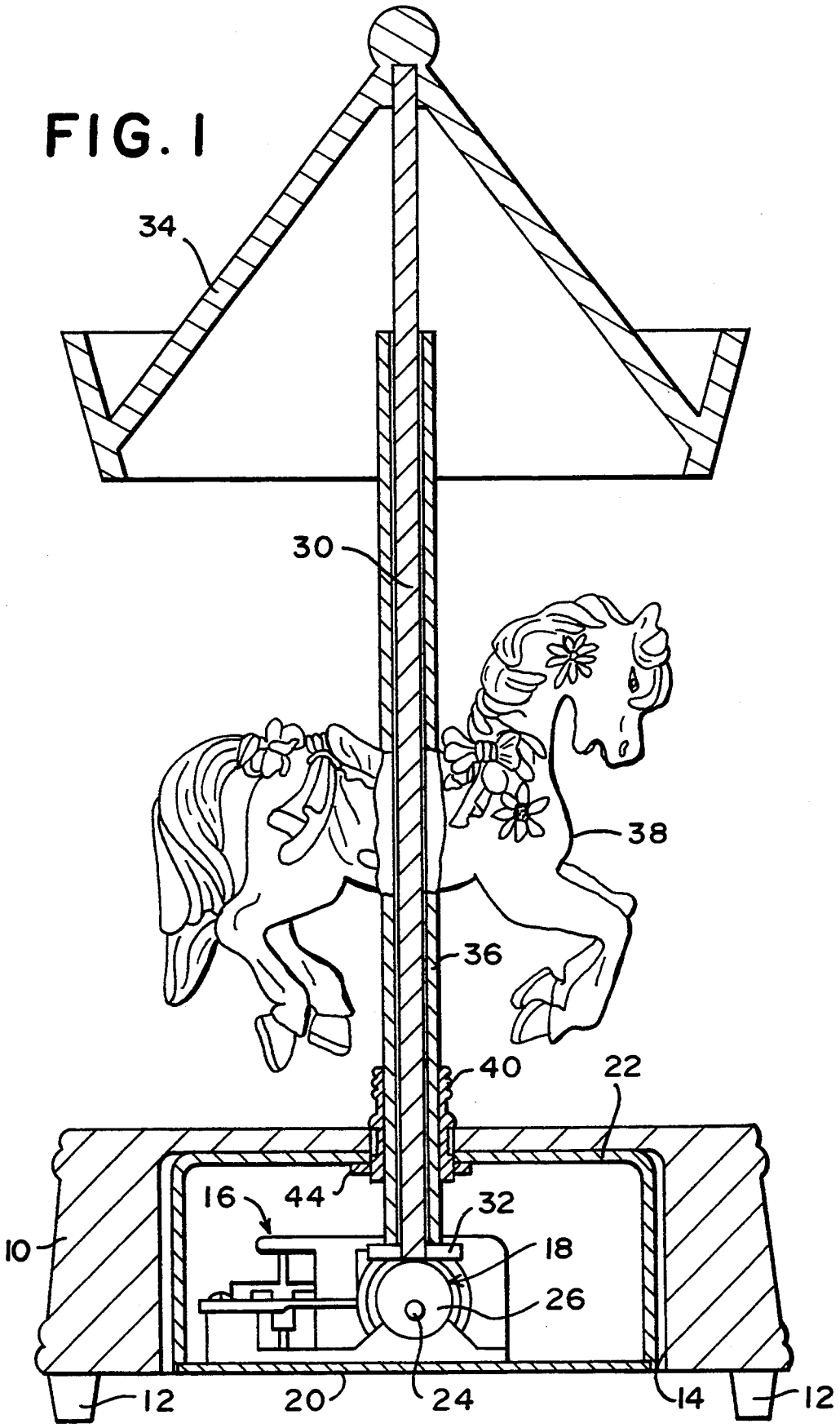
FIG. 1 is a side view, partially in section, of a first embodiment of the ornamental display assembly according to the present invention.
Figure 2:
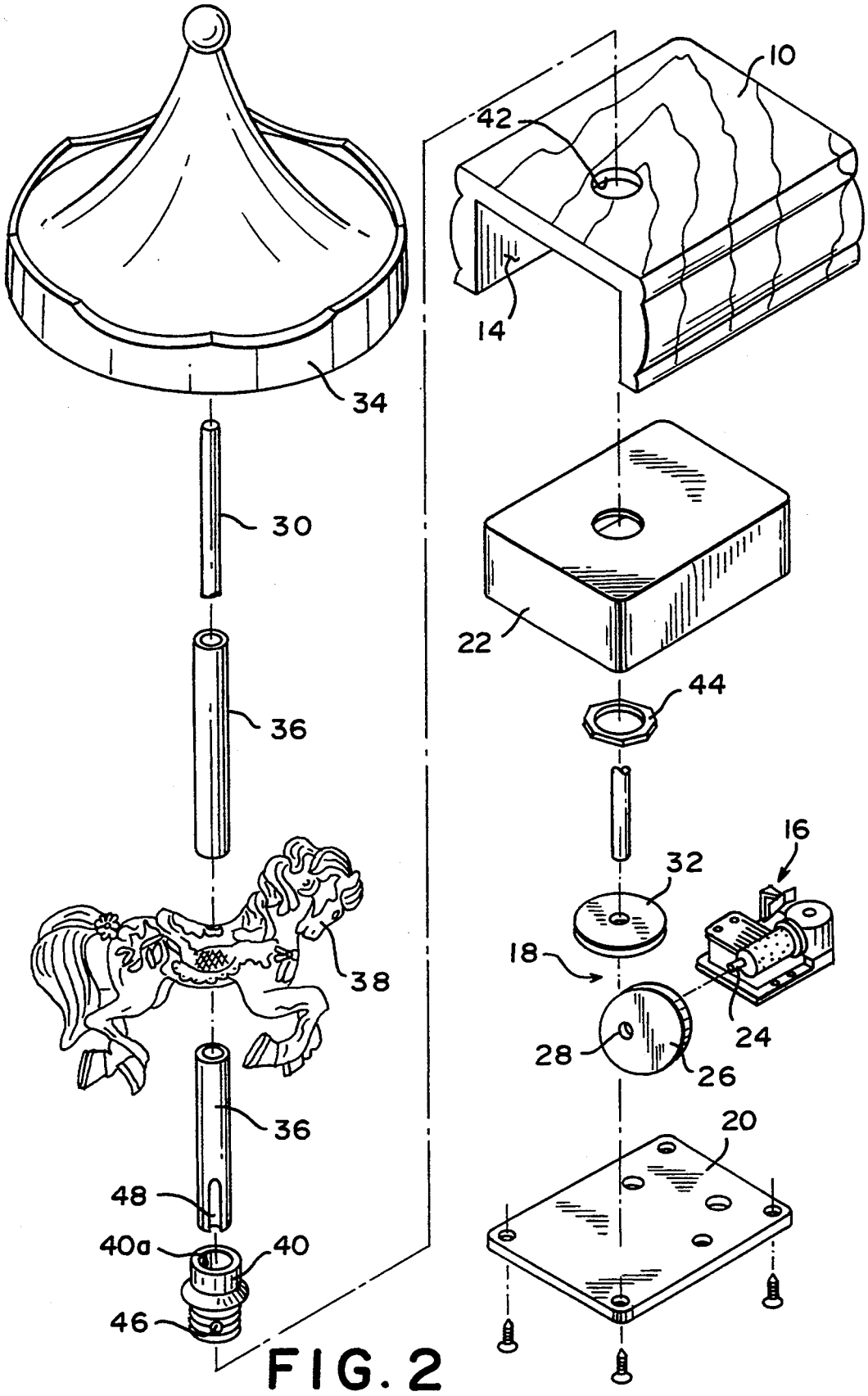
FIG. 2 is an exploded, perspective view of the ornamental display assembly shown in FIG. 1.
Figure 6:
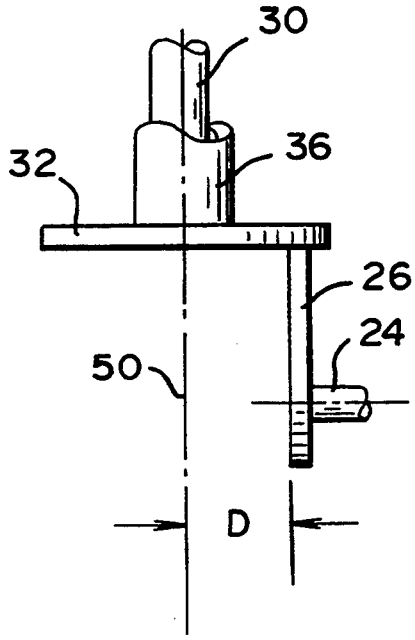
FIG. 6 is a partial, front view of the cam drive mechanism utilized with the embodiment illustrated in FIGS. 1 and 2 according to the present invention.

A first embodiment of the ornamental display device according to the present invention is illustrated in FIGS. 1, 2 and 6 and comprises a base 10 which may have support legs 12 for supporting the display assembly on a surface (not shown). The base 10 defines an opening 14 which may accommodate a known music box mechanism 16 and a drive mechanism, indicated generally at 18. The music box mechanism 16 may be attached to mounting plate 20 which, in turn, may be attached to cover 22 by known means. The opening 14 defined by the base 10 is of sufficient size to fully accommodate the mounting plate 20 and the cover 22 therein, as illustrated in FIG. 1. A windup key for the music box mechanism may be attached to the music box mechanism 16 so as to extend exteriorly of the mounting plate 20 to facilitate the winding of the music box mechanism.

The music box mechanism 16 has an output shaft 24 extending from one end of the music drum, which shaft 24 rotates as the music drum is rotated by the main spring of the music box mechanism. A circular cam member 26 is eccentrically mounted on output shaft 24, which may extend into hole 28 such that the cam member 26 rotates with the shaft 24.

Elongated support member 30 has a first end attached to drive disc 32 and a second end attached to a decorative element 34, in this particular instance, a carousel-type canopy. The drive disc 32 is fixedly attached to the support member 30 so as to rotate therewith, as is the decorative element 34. A second elongated support member 36 having a hollow tubular configuration is concentrically arranged about the support member 30 and has a first end which may bear against an upper surface of drive disc 32. Support member 36 has a second decorative element 38 attached thereto, which in this particular instance, is a carousel-type horse. Support member 36 may be either a single, unitary tubular element extending through decorative element 38, or may be a two-piece tubular element extending from the top and bottom of the decorative dement 38, as illustrated in FIGS. 1 and 2. In either case, decorative element 38 is mounted so as to move with support member 36.

Support member 36 is slidably supported on base 10 by journal coupling 40 which extends through opening 42 in the base 10 and is fixedly attached thereto by nut 44. Journal coupling 40 defines a central passage 40*a* which slidably accepts support member 36. Journal coupling 40 has pin element 46 extending inwardly into the central passage 40*a* such that an inner end of pin 46 may engage elongated slot 48 formed in an external surface of support member 36. The engagement of these elements will prevent relative rotation of support member 36 (as well as decorative element 38) with respect to the journal coupling 40, but will allow support member 36 and decorative element 38 to linearly reciprocate along axis 50.

As best illustrated in FIG. 6, the drive disc 32 is in frictional contact with the peripheral surface of circular cam 26 at a location which is laterally displaced a distance D from the longitudinal axis 50 of the support members 30 and 36. This frictional contact will cause drive disc 32 to rotate about axis 50, as well as linearly reciprocate along axis 50 as the eccentric cam member 26 rotates about the axis of output shaft 24. Since drive disc 32 is fixedly connected to the end of support member 30, this support member, as well as the decorative element 34 will rotate about axis 50 as well as reciprocate along this axis. However, since support member 36 cannot rotate, due to the interengagement of pin 46 and slot 48, the support member 36 and the decorative element 38 will only reciprocate in a linear direction along axis 50 with respect to the base 10. The use of coaxially arranged support members enables the two separate decorative elements 34 and 38 to be laterally aligned, but vertically displaced on the base 10. The drive mechanism enables the decorative elements to undergo separate types of movement utilizing a single drive means.

Figure 3:
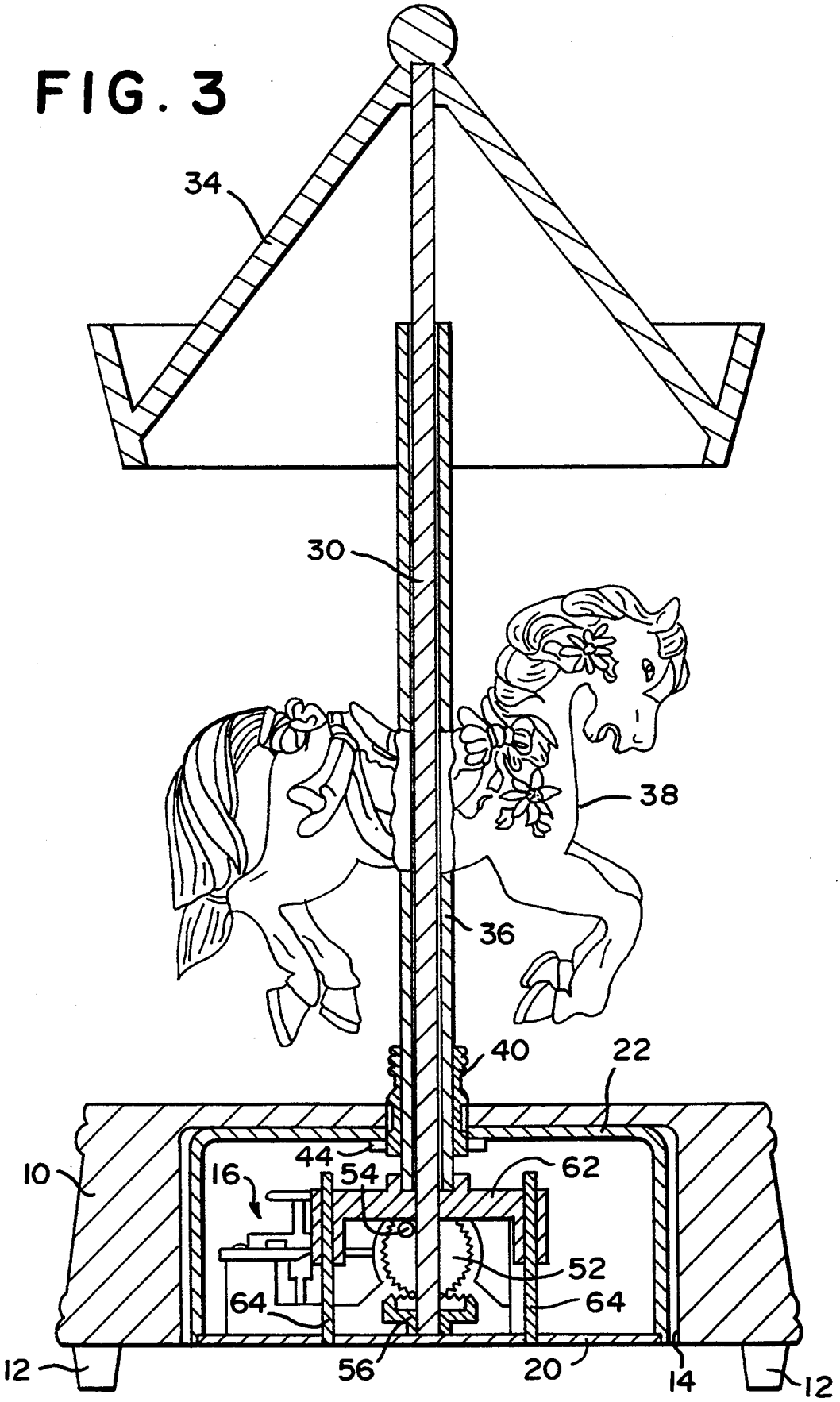
FIG. 3 s a side view, partially in cross section, of a second embodiment of the ornamental display assembly according to the present invention.
Figure 4:
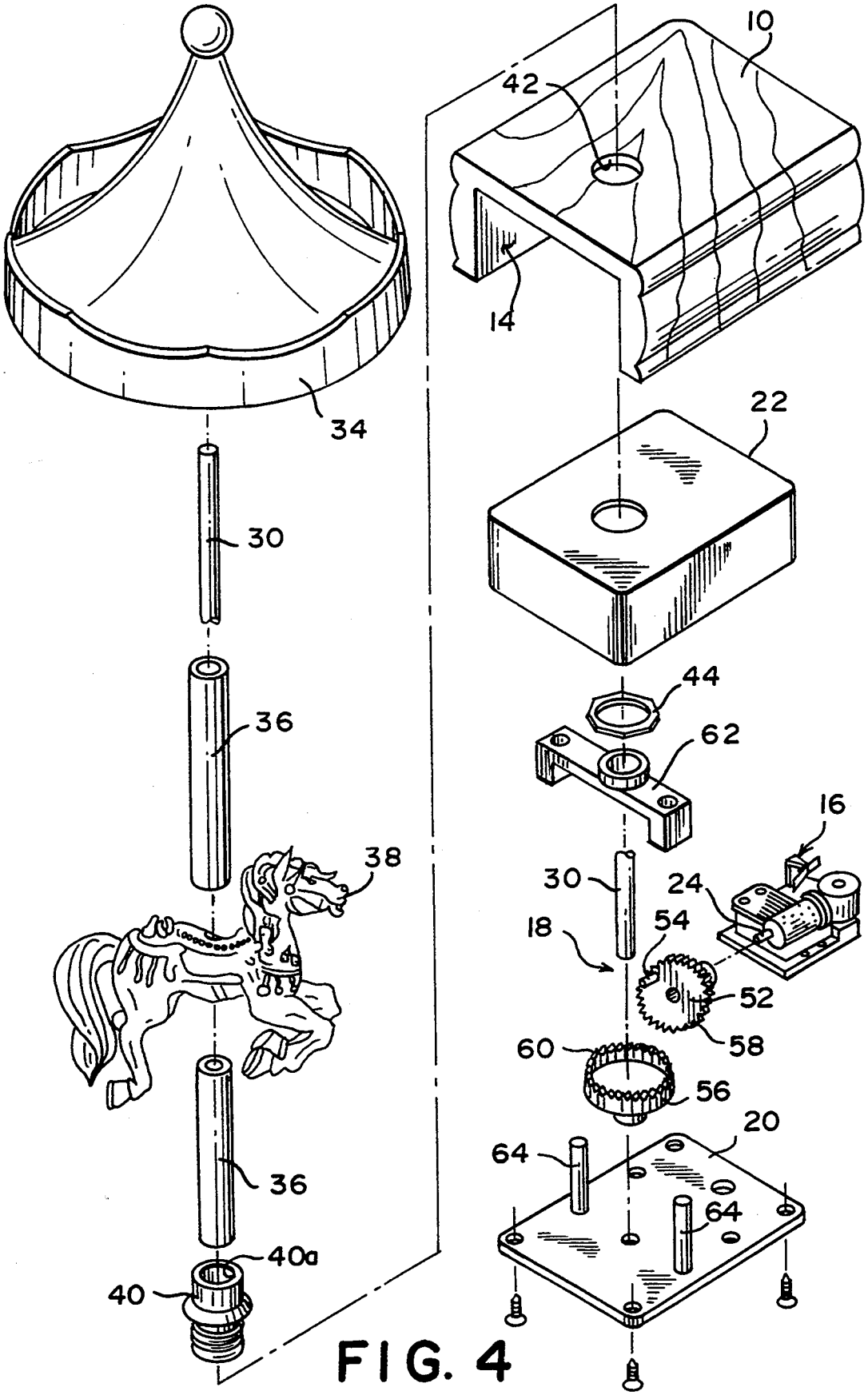
FIG. 4 is an exploded, perspective view of the ornamental display assembly illustrated in FIG. 3.

A second embodiment of the ornamental assembly according to this invention is illustrated in FIGS. 3 and 4. Elements which are common to the previously described embodiment have been given the same identifying numbers. In this embodiment, the drive mechanism 18 comprises a circular cam member 52 centrally attached to the output shaft 24 of the music box mechanism 16 so as to rotate therewith. Cam member 52 is attached to the shaft 24 so as to rotate about a central axis. Cam stub 54 extends laterally from the plane of the cam member 52 and is eccentrically located with respect to the output shaft 24. Drive disc 56 is fixedly attached to the end of shaft 30 so as to rotate therewith and may bear against an upper surface of mounting plate 20. As can be seen, cam member 52 and drive disc 56 have gear teeth 58 and 60, respectively, formed thereon such that rotation of the cam member 52 will cause rotation of the drive disc 56 and, consequently, rotation of the support member 30. This will also cause rotation of decorative element 34, since it is fixedly attached to the opposite end of support member 30. In this embodiment, decorative element 34 does not undergo reciprocating movement, but undergoes only rotational movement.

Slide member 62 is attached to an end of support member 36 and is slidably mounted on guides 64 extending upwardly from the mounting plate 20. Slide member 62 is located such that it is in contact with cam stub 54, as best illustrated in FIG. 3. As can be seen, rotation of cam element 52 will cause linear reciprocating movement of slide 62 along the guides 64, which movement will impart a similar linear reciprocating movement to support member 36 as well as decorative element 38. In this embodiment, journal coupling 40 slidably supports the second support member 36 without the need for pin 46 or slot 48. Rotation of decorative element 38 and support member 36 is prevented by their connection to the slide member 62, whose movement is limited to linear reciprocation along guides 64.

Figure 5:
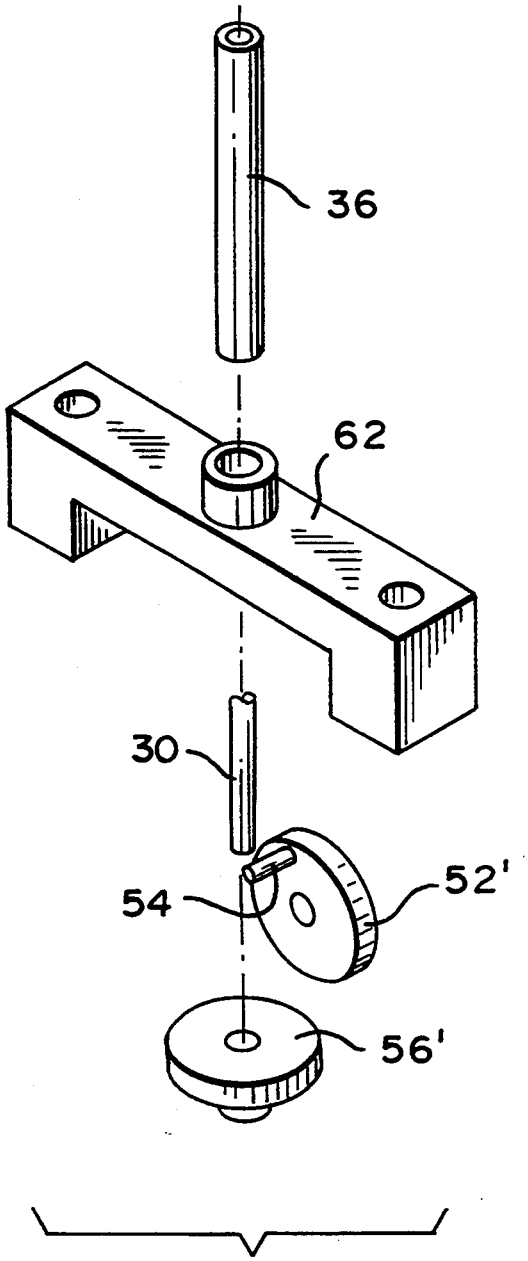
FIG. 5 is a partial, exploded, perspective view illustrating a modified drive system for the embodiment illustrated in FIGS. 3 and 4.
Figure 7:
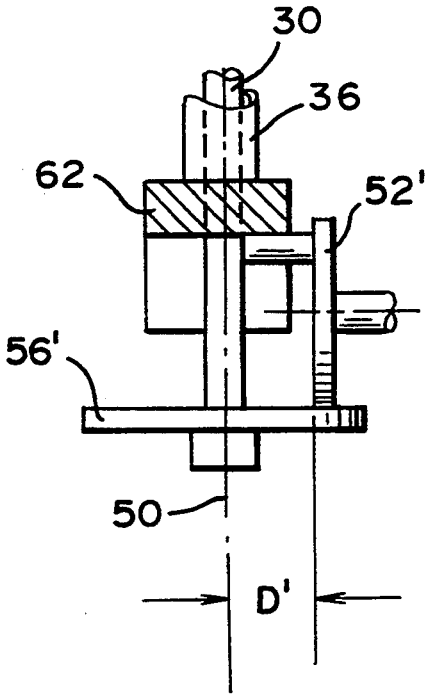
FIG. 7 is a partial, front view illustrating the cam drive mechanism utilized with the embodiment illustrated in FIG. 5.

The drive mechanism of this embodiment may be modified as illustrated in FIGS. 5 and 7. In this modification, interengaging gear teeth 58 and 60 are eliminated, and cam member 52' and drive disc 56' are in frictional contact with each other. Since this frictional contact is laterally displaced from the axis of rotation 50 of the support member 30 a distance D', rotation of the cam member 52' will cause rotation of the drive disc 56' about axis 50.

The foregoing description is provided for illustrative purposes only and should not be construed as in any way limiting this invention, the scope of which is defined solely by the appended claims.

I claim:

1. An ornamental device comprising:

a) a base;

b) first and second coaxially arranged support members having a common axis and supported on the base; and c) a common drive means connected to the first and second support members for rotating one of the first and second support members and linearly reciprocating without rotation the other of the first and second support members, wherein the common drive means comprises a music box mechanism as a power source having a rotatable output shaft.

2. The ornamental device of claim 1 wherein the common drive means comprises:

a) rotatable cam means; and b) a drive transmission connecting the rotatable cam means, and the first and second support members such that rotation of the rotatable cam means causes the rotation of the first member about an axis of rotation and the reciprocation of the second member.

3. The ornamental device of claim 2 wherein the drive transmission comprises a cam follower engaged with the first and second members and in frictional contact with the rotatable cam means at a location laterally displaced from the axis of rotation of the first member.

4. The ornamental device of claim 3 wherein the rotatable cam means comprises an eccentric cam member rotatable in a plane extending generally perpendicular to a plane of the cam follower.

5. The ornamental device of claim 2 wherein the drive transmission comprises:

a) a slide member engaging the rotatable cam means and the second support member such that rotation of the cam means causes linear reciprocation without rotation of the second member; and, b) a drive disc connected to the first support member and engaging the rotatable cam means such that rotation of the cam means causes rotation of the first support member.

6. The ornamental device of claim 5 wherein the rotatable cam means comprises:

a) a substantially circular cam member attached to the output shaft so as to rotate therewith; and, b) a cam stub located eccentrically on and extending from the cam member in contact with the slide member during rotation of the output shaft.

7. The ornamental device of claim 6 further comprising:

a) a first plurality of gear teeth formed on the substantially circular cam member; and, b) a second plurality of gear teeth formed on the drive disc in engagement with the first plurality of gear teeth.

8. The ornamental device of claim 6 wherein the cam member frictionally contacts the drive disc at a location laterally displaced from the axis of rotation of the first member.

9. The ornamental device of claim 1 further comprising:

a) a first decorative object connected to the first member so as to rotate therewith; and, b) a second decorative object connected to the second member so as to reciprocate therewith.

10. An ornamental device comprising:

a) a base;

b) first and second coaxially arranged support members having a common axis and supported on the base; and c) a common drive means connected to the first and second support members for rotating one of the first and second support members and linearly reciprocating without rotation the other of the first and second support members, wherein the common drive means comprises:

i) rotatable cam means; and ii) a drive transmission connecting the rotatable cam means, and the first and second support members such that rotation of the rotatable cam means causes the rotation of the first member about an axis of rotation and the reciprocation of the second member.

11. The ornamental device of claim 10 wherein the common drive means comprises a power source having a rotatable output shaft.

12. The ornamental device of claim 10 wherein the drive transmission comprises a cam follower engaged with the first and second members and in frictional contact with the rotatable cam means at a location laterally displaced from the axis of rotation of the first member.

13. The ornamental device of claim 12 wherein the rotatable cam means comprises an eccentric cam member rotatable in a plane extending generally perpendicular to a plane of the cam follower.

14. The ornamental device of claim 10 wherein the drive transmission comprises:

a) a slide member engaging the rotatable cam means and the second support member such that rotation of the cam means causes linear reciprocation without rotation of the second member; and, b) a drive disc connected to the first support member and engaging the rotatable cam means such that rotation of the cam means causes rotation of the first support member.

15. The ornamental device of claim 14 wherein the common drive means comprises a power source having a rotatable output shaft.

16. The ornamental device of claim 15 wherein the rotatable cam means comprises:

a) a substantially circular cam member attached to the output shaft so as to rotate therewith; and, b) a cam stub located eccentrically on and extending from the cam member in contact with the slide member during rotation of the output shaft.

17. The ornamental device of claim 16 further comprising:

a) a first plurality of gear teeth formed on the substantially circular cam member; and, b) a second plurality of gear teeth formed on the drive disc in engagement with the first plurality of gear teeth.

18. The ornamental device of claim 16 wherein the cam member frictionally contacts the drive disc at a location laterally displaced from the axis of rotation of the first member.

19. The ornamental device of claim 10 further comprising:

a) a first decorative object connected to the first member so as to rotate therewith; and, b) a second decorative object connected to the second member so as to reciprocate therewith.

* * * * *